United States Patent [19]

Serbent et al.

[11] 4,391,583

[45] Jul. 5, 1983

[54] PROCESS OF THERMALLY TREATING BULK MATERIALS IN A ROTARY KILN

[75] Inventors: Harry Serbent, Hanau; Detlev Schlebusch, Wöllstadt; Gerhard Reuter, München-Aschheim; Wolfram Schnabel, Idstein, all of Fed. Rep. of Germany

[73] Assignee: Metallgesellschaft Aktiengesellschaft, Frankfurt am Main, Fed. Rep. of Germany

[21] Appl. No.: 310,953

[22] Filed: Oct. 13, 1981

[30] Foreign Application Priority Data

Oct. 17, 1980 [DE] Fed. Rep. of Germany ..... 3039212

[51] Int. Cl.[3] ..... F27D 7/00; F27D 23/00; F27B 7/38

[52] U.S. Cl. ..... 432/4; 266/241; 432/77; 432/116

[58] Field of Search ..... 432/4, 77, 116, 233; 266/241

[56] References Cited

U.S. PATENT DOCUMENTS

| | | | |
|---|---|---|---|
| 118,674 | 9/1871 | Baynton | 122/6 R |
| 939,817 | 11/1909 | Edison | 432/116 |
| 1,869,237 | 7/1932 | Bruhn | 432/116 |
| 2,671,858 | 3/1954 | Moore | 266/241 |
| 4,102,530 | 7/1978 | Hawkes et al. | 432/116 |

FOREIGN PATENT DOCUMENTS

| | | | |
|---|---|---|---|
| 2626211 | 12/1977 | Fed. Rep. of Germany | 266/241 |
| 652138 | 4/1951 | United Kingdom | 432/116 |

*Primary Examiner*—John J. Camby

*Attorney, Agent, or Firm*—Sprung, Horn, Kramer & Woods

[57] ABSTRACT

In the treatment of bulk materials with hot gases below the melting point of the charge component it is desired to prevent a formation of undesired crusts during normal operation and when the rotary kiln is operated at a reduced speed during short-time trouble. For this purpose, a controlled dissipation of heat is effected in several sections of the rotary kiln in that the shell of the kiln and the refractory lining are cooled so that the temperature of that portion of the inside surface of the rotary kiln which is submerged below the charge is always maintained at or up to 50° C. below the temperature of the charge disposed thereover.

12 Claims, 9 Drawing Figures

PROCESS OF THERMALLY TREATING BULK MATERIALS IN A ROTARY KILN

BACKGROUND OF THE INVENTION

1. Field of the Invention

This invention relates to a process of thermally treating bulk material with hot gases in a rotary kiln below the melting point of the charge components in the rotary kiln while cooling the shell and refractory lining of the kiln.

2. Discussion of Prior Art

In such processes carried out in a rotary kiln, for instance during a direct reduction of iron ore to produce sponge iron or during the volatilization of non-ferrous metals from metallurgical plant residue with simultaneous reduction of the iron oxides to produce sponge iron in a direct reducing process or waelz process or during roasting or calcining processes or the production of quicklime in the rotary kiln, heat is transferred from the hot gas to the solid charge (a) by radiation from the gas, (b) by convection and (c) by way of the heated refractory lining of the rotary kiln.

The last-mentioned part of the heat is called stored heat and consists of that quantity of heat which is taken up by the refractory lining while it is in direct contact with the flue gas in the free space in the kiln and which is subsequently delivered by the refractory lining to the charge when the heated lining is being submerged under the charge which is traveling through the rotary kiln.

An essential problem arising in rotary kiln technology resides in that the various heat transfer modes, which are governed by different physical laws, must be matched to each other and to the process to be carried out as well as to the behavior of the charge materials. In this connection the fact that various materials which are to be thermally treated tend to form deposits and crusts on the inside surface of the kiln is of decisive significance. The formation of deposits and crusts is influenced by the chemical and physical properties of the various materials which are charged or of mixtures thereof or of any new materials formed by them and is closely related to the heat transfer and particularly to the temperature difference between the inside surface of the kiln and the charge material contacting said inside surface at a given point of the kiln. For instance, if the inside surface of the kiln is at an excessively high temperature, much more heat may of offered to the charge in contact with that inside surface than can be taken up by that charge, dissipated into the interior of the charge, and consumed for reactions in the time concerned. As a result, the charge particles directly contacting the inside surface of the kiln will be overheated and may superficially melt so that the particles may adhere to the inside surface of the kiln and to other charge particles. The effect of that phenomenon on individual particles will increase as their particle size and their volume related to their surface area decrease.

This crust-forming mechanism is typical for rotarty kiln processes, particularly for those mentioned above, and when occurring pronouncedly will result in trouble in operation so that it may be necessary to stop the rotary kiln for a removal of the crusts. A small deposit may be desirable for the protection of the refractory lining but should not grow in excess of the desired thickness.

Particularly during an interruption of the operation of the rotary kiln for a short time, for instance because there is a power failure and the rotary kiln is driven by emergency drive means or because the main drive means are operated at an extremely low speed, the heat transfer will be no longer uniform and the heat which is released will not be consumed at the usual rate. This will result in a retention of heat so that the refractory lining and the charge will be overheated and the overheating will result in a sintering of the charge and in a formation of crusts, particularly in the hotter zones of the rotary kiln.

It is known that a formation of crusts before a melting and sintering zone can be prevented in that the interior of the kiln is directly cooled at the charging end in the region in which crusts might form. Specifically, water can be sprayed into the interior and into the charge (German Utility Model No. 1,726,762). If the rotary kiln is cooled by a water jacket or by cooling pipes, the water which is sprayed is tapped from the cooling conduits in the kiln. That process requires an introduction of water into the rotary kiln and can be used only if the tendency to form crusts is restricted to one region. Otherwise, a large number of through bores and feed conduits would have to be distributed over the length of and around the periphery of the kiln.

In the production of cement it is also known to maintain the temperature of the refractory lining above the temperature at which a crust may form. The inside surface of the kiln is maintained at such a high temperature that any melting or sintering constituents cannot adhere to and solidify on the refractory lining (Austrian Patent Specification No. 231,339). But that process cannot be adopted to solve the problems involved in the formation of crusts in rotary kiln processes carried out below the melting and softening points of the charge components.

Numerous processes to protecting the refractory lining or the shell of the kiln have been disclosed. For instance, it is known to provide water-cooled cooling boxed around length sections of the kiln (German Patent Specification No. 2,495; German Patent Specification No. 116,732; Early German Disclosure No. 21 45 188) or to provide cooling pipes in the refractory lining in order to effect a cooling which in some cases causes a slag layer to be formed on the refractory lining (German Patent Specification No. 13,136; 21,220; 1,043,365; 1,006,780; 1,010,444) or to sprinkle water on the entire shell of the kiln or on part thereof so as to cause a slag layer to form (U.S. Patent Specification No. 939,817; German Patent Specification No. 698,732) or to provide stationary cooling pipes, which surround the shell of the kiln and in some cases permit of a utilization of the heat which is transferred by the cooling fluid (German Patent Publication No. 23 37 862; German Early Disclosure No. 27 47 457). But these processes do not solve the problem how to prevent the formation of undersired crusts.

It is an object of the invention to prevent in a rotary kiln formation of crusts during normal operation and when the kiln is operated at a reduced speed during short-time trouble.

This object is accomplished according to the invention in that several sections of the rotary kiln are cooled to effect a controlled dissipation of heat so that the temperature of the inside surface of the kiln in the portion which is being submerged under the charge is always maintained at or up to 50° C. below the temperature of the charge disposed thereover. When the inside surface in a given cross section of the rotary kiln has risen above the rolling bed formed by the charge, the temperature of said inside surface rises as far as to that portion of the inside surface which is moving below the rolling bed. That portion is described as the portion which is being submerged. The inside surface is formed either by the refractory lining or by the desirable covering layer. The cooling is effected in such a manner that the temperature of that part of the inside surface which is not covered by the rolling bed but exposed does not rise above the temperature of the charge or does so rise and is lowered to a point not above the charge until it is being submerged. If the inside surface is maintained at the described temperature which is at or up to 50° C. lower than the temperature of the charge adjacent thereto, formation of crusts is reliably avoided and an unnecessary dissipation of heat from the charge to the cooling fluid is also avoided. Cooling is effected in those length sections of the rotary kiln in which the temperature of the charge is already so high that a further temperature rise caused by a heat transfer from the hotter inside surface of the kiln results in a softening or melting of charge constituents and in formation of crust. For safety reasons, the cooling may begin a certain distance before that point so that temperature fluctuations are compensated.

According to a preferred feature, cooling is effected by sprinkling water in a controlled manner on sections of the of the shell of the kiln. In that manner, cooling is effected with a low expenditure.

According to a further preferred feature, water is sprinkled on the shell of the rotary kiln when the latter is operated at a reduced speed or is stopped during short-time troubles. Such troubles occur during a power failure, when the rotary kiln is driven at a lower speed by emergency drive means or during short-time repairs. The water rate is controlled so that the surplus heat is dissipated and there is no formation of crusts and sintering. The water can be kept available in an overhead tank if a power failure would result also in a failure of the water supply and there is no emergency supply. That cooling can be provided for rotary kilns which are not cooled during normal operation as well as for rotary kilns which are cooled during normal operation.

According to a further preferred feature, water is sprinkled on those sections of the shell in which a retention of heat causes the temperature in the charge to exceed the highest permissible temperature. The sprinkling of water begins shortly before the section in which the charge reaches that temperature so that an unnecessary cooling of the preceding sections is avoided.

According to a further preferred feature, the means for sprinkling water is connected to the interlock system and their operation is initiated automatically in response to a trouble in the operation of the kiln. In that case, a trouble in the operation of the kiln automatically initiates a cooling and overheating is safely avoided.

According to a further preferred feature, at least a major part of the water is sprinkled on that portion of the shell of the kiln which is opposite to the rolling bed formed by the charge. This avoids a lowering of the temperature of the inside surface of the kiln to an unnecessary low value also in that portion which is covered by the rolling bed and a dissipation of heat from the charge.

According to a further preferred feature, cooling is effected by means of pipes which are installed in the refractory lining of the kiln and flown through by a cooling fluid and the heat absorbed by the cooling fluid is utilized for other purposes. The cooling fluid consists usually of water and its heat content is utilized when the water has left the kiln. In that case, part of the dissipated heat can be utilized for useful purposes so that the structural expenditure is justified in some cases.

According to a further preferred feature, more energy is supplied to the rotary kiln than is required for carrying out the process and the surplus is utilized to heat the cooling fluid in the pipes to a temperature which is favorable for other purposes. In this way the temperature of the cooling fluid can be increased so that its heat content is available on a more valuable level. In that case heat can be dissipated also from sections which would not be cooled otherwise.

According to a further preferred feature, the temperature of the inside surface of the rotary kiln and the temperature of the charge are measured in several sections of the rotary kiln and the dissipation of heat is controlled in dependence on the temperature difference. That arrangement is particularly useful if the rotary kiln is operated under conditions which do not remain constant permanently or for prolonged periods of time. In the manner described, the rate at which heat is dissipated by cooling can be minimized while a formation of crusts is nevertheless reliably prevented.

According to a further preferred feature, a rotary kiln used to produce sponge iron is cooled through the length of the reducing zone and that cooling begins approximately where the wüstite begins to form. In this way best results are produced with a low expenditure in that process.

BRIEF DESCRIPTION OF DRAWINGS

The invention will be explained more in detail and by way of example with reference to the drawings, in which.

DESCRIPTION OF SPECIFIC EMBODIMENTS

Figure 1:
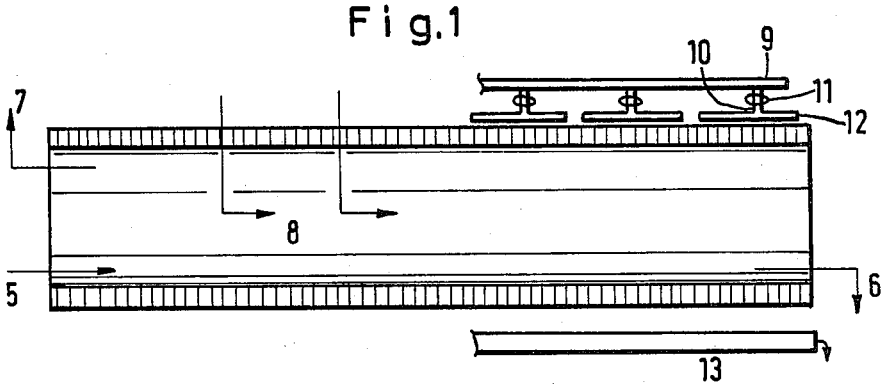
FIG. 1 is a diagrammatic longitudinal sectional view showing a rotary kiln which is sprinkled with water.
Figure 2:
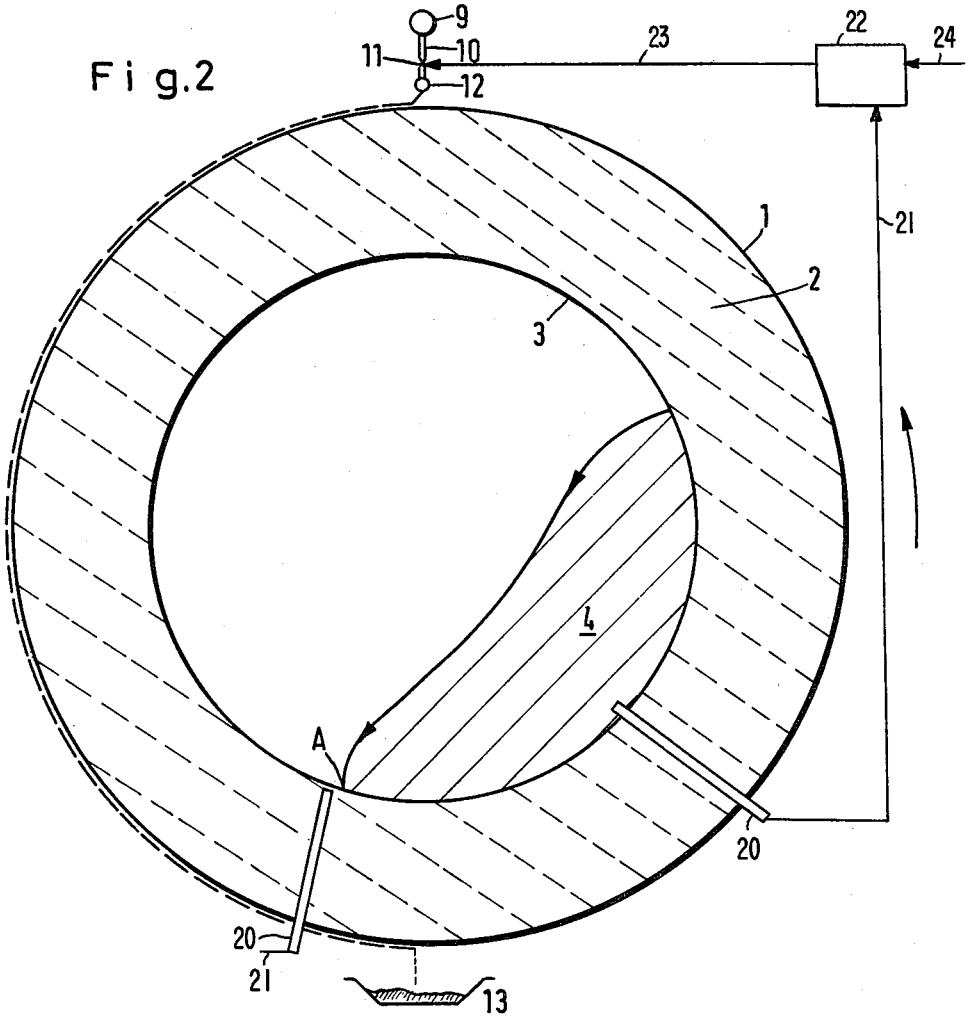
FIG. 2 is a diagrammatic transverse section view showing a rotary kiln which is sprinkled with water.

FIGS. 1 and 2 show a steel shell 1 provided with a refractory lining 2, which has an inside surface 3 in contact with a rolling bed 4. In accordance with FIG. 1, the charge is fed at 5, the solid reaction product is discharged at 6 and the exhaust gas leaves the rotary kiln at 7. Only two shell tubes 8 are shown, which blow air into the kiln. A supply manifold 9 is connected by branch pipes 10, provided with valves 11 to spray pipes 12, from which water flows at controlled rates onto the steel shell 1. FIG. 2 shows how the inside surface 3 is submerged at A under the rolling bed 4. The water trickling over the left-hand side of the kiln is collected in a collecting trough 13.

As shown in FIG. 2, a thermocouple 20 is connected by line 21 to a computer 22 via rings on the shell and bushes (are not shown). In computer 22, the wall temperature at point "A" is compared with the temperature of the charge behind point "A". When a temperature difference is detected, a signal is sent via line 23 to valve 11 to start to regulate the flow of water. By line 24, the computer 22 is connected to the interlock system. If a power failure occurs, computer 22 sends a signal via line 23 which opens valve 11.

Figure 8:
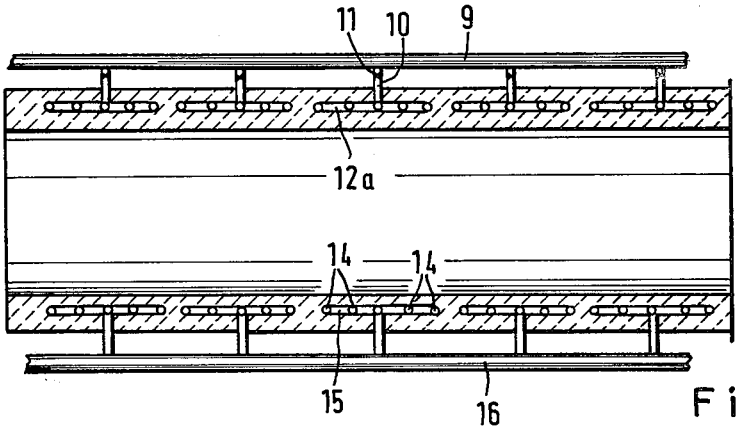
FIG. 8 is a diagrammatic longitudinal sectional view showing a rotary kiln in which cooling pipes are installed in the refractory lining.

As shown in FIG. 8, heated cooling fluid is led from the drain pipe via line 30 into a heat exchanger 31. Cold water from a steam generating plant is fed to the heat exchanger 31 via line 32, heated by heat exchange with the hot cooling fluid and discharged via line 33. The cooled cooling fluid is discharged via line 34 and can be reintroduced into manifold 9.

The invention may also be applied to a co-current process in which the charge and the gas atmosphere in the rotary kiln move in the same direction.

EXAMPLES

(1) Controlled cooling by water sprinkled on the shell of the kiln

A cooling system as shown in FIG. 1 and 2 was installed on a rotary kiln used for a direct reduction of iron ore pellets and having a shell 50 meters long and 3.6 meters in diameter. Cooling was effected over a distance of 30 meters, beginning after 20 meters of the length of the kiln viewed toward the discharge end. In continuous operation the kiln was fed with iron ore pellets at a rate of 17.8 metric tons per hour and with moderately reactive coal of medium volatility at a rate of 11.6 metric tons per hour. The reaction temperatures in the charge were about 1040° C. After 30 meters of the length of the kiln, the inside surface of the latter exceeded the charge temperature by about 100° C., on an average.

The means for effecting a controlled cooling were so arranged that the individually controlled cooling pipes of 1.5 meters length each together with the branch pipes and motor-actuated valves were mounted on a stationary supply manifold installed over the kiln. The cooling water running down was collected in a collecting trough under the shell of the kiln and was drained toward and at the discharge end.

In order to measure the temperature of the inside surface of the kiln and of the charge, two NiCr/Ni thermocouples having a fast response were provided on every 3 meters of the kiln length in addition to the existing thermocouples. One of said two thermocouples was used to measure the wall temperature and was embedded in the refractory lining to extend as far as to the surface of the refractory lining. The second thermocouple extended through the refractory lining and protruded from the same about 15 cm into the free space in the kiln and during the rotation of the kiln measured the temperatures of the rolling charge in the kiln and of the free gas space. Such pair of thermocouples were provided under each spray pipe. The motor-operated flow control valves which were provided on the distributing pipes and associated with respective pairs of thermocouples were controlled by sensors and signal generators in such a manner that the cooling water was supplied to the spray pipes at a flow rate which increased linearly with increasing temperature difference between the inside surface of the kiln and the charge. The adjustment was effected in such a manner that there was no cooling when the inside surface of the kiln was cooler by 50° C. than the charge, and the cooling water flow rate increased as the temperature of the inside surface of the kiln increased. The valve was entirely opened when there was a positive difference $T_{wall}$-$T_{charge}$, i.e., when the inside surface of the kiln was hotter than the charge.

Figure 3:
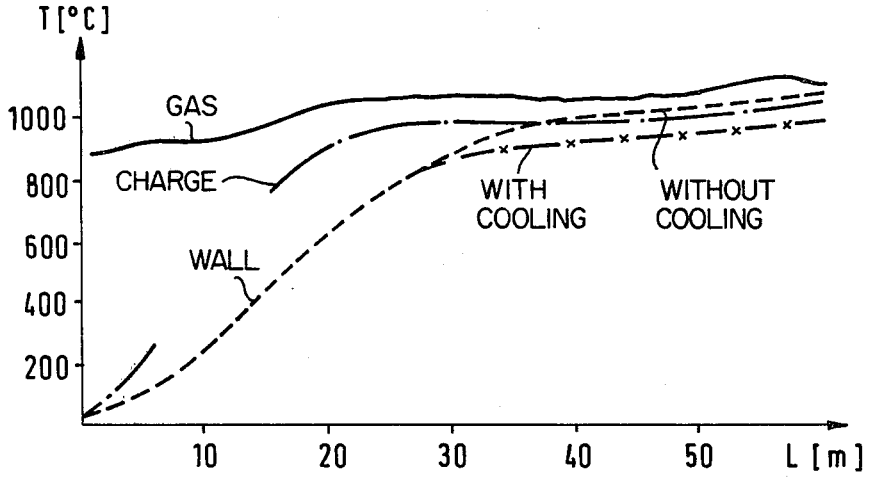
FIG. 3 represents the temperature changes in the kiln with or without a sprinking of water during normal operation.

FIG. 3 shows the temperature changes taking place in the gas space, the charge, and the inside surface of the kiln during normal operation of the kiln with and without cooling. With the measures described, it was possible to effect, particularly in the last one-third of the length of the kiln, a controlled lowering of the temperature of the inside surface of the kiln below the temperature of the charge so that sticking of charge material on overheated portions of the refractory lining was avoided and the wear of the latter was reduced.

An increase of the rate at which coal was to be added because the increased dissipation of heat through the wall of the kiln resulted in a loss of stored heat used to heat the charge in contact with the hotter inside surface of the kiln was not observed.

(2) Cooling by a sprinkling with water during a rotation of the kiln at a reduced speed owing to short-time troubles The kiln and its mode of operation were the same as in Example 1. During normal operation at a speed of 0.7 $min^{-1}$ (rpm), the temperature of the charge amounted to about 1040° C. and the gas temperature to about 1080° C. in the reducing zone. 5 meters before the discharge end of the kiln, its inside surface had a temperature of about 1060° C. The kiln was provided with auxiliary drive means, which in case of a power failure maintained a speed of about 0.05 $min^{-1}$ (rpm).

Figure 4:
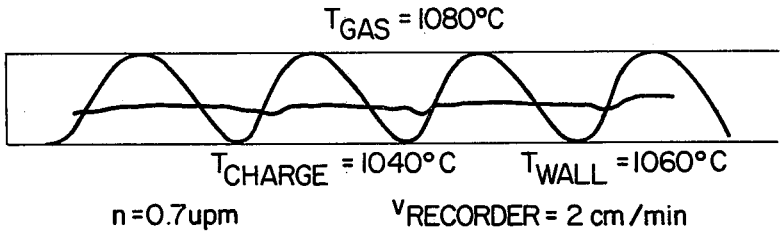
FIGS. 4 to 7 show the influence of the sprinking of water on the temperature in the kiln which is operated at a reduced speed during a trouble.
Figure 5:
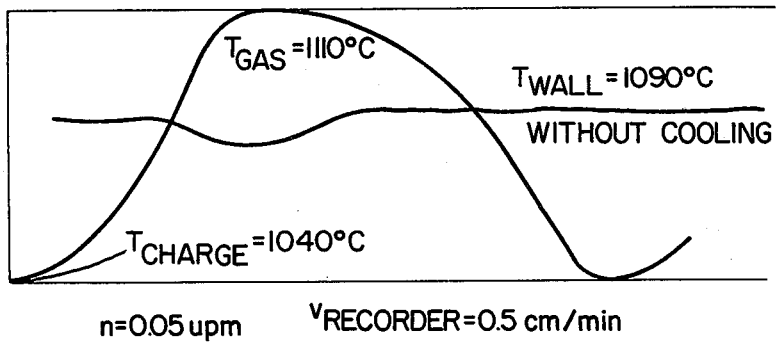
Figure 6:
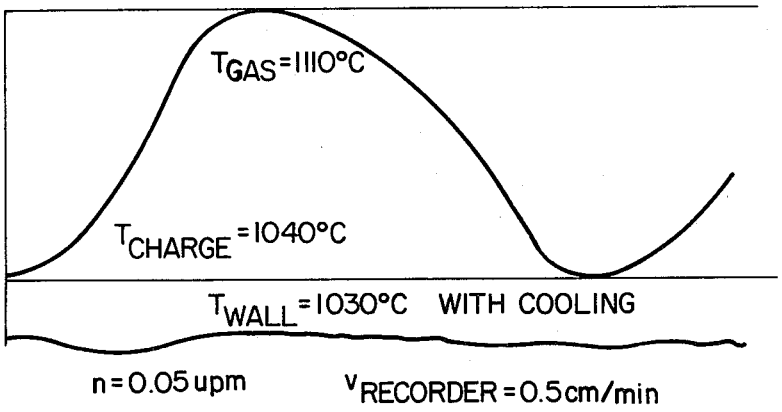
Figure 7:
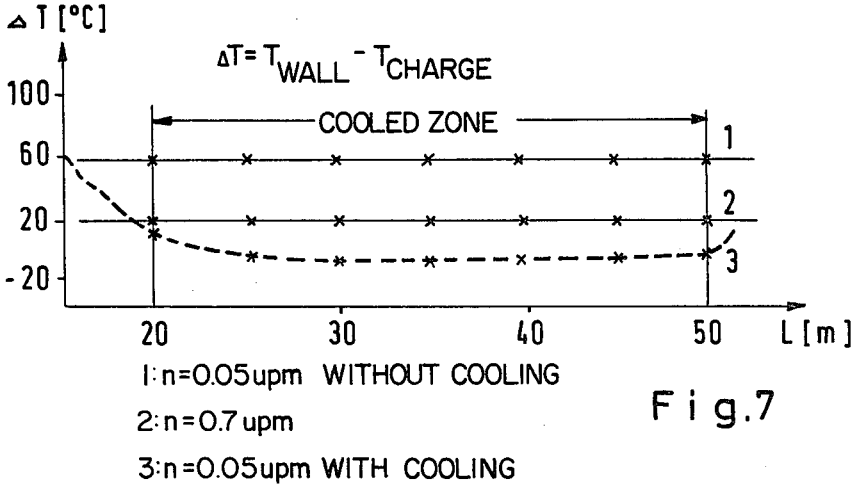

The temperature of the charge, of the gas and of the inside surface of the kiln are represented for a normal speed of 0.7 $min^{-1}$ (revolutions per minute) in FIG. 4 and for a reduced speed of $0.05^{-1}$ (rpm) without cooling in FIG. 5 and with cooling after the occurrence of the simulated trouble in FIG. 6. The temperatures were measured 5 meters before the discharge end of the kiln. The temperatures of the inside surface and charge were higher at the reduced speed by about 30° C. than in normal operation and by the sprinkling of water were reduced by about 60° C., i.e., to 30° C. below the temperature of the inside surface during normal operation. In FIG. 7, the lowering of wall temperature along the cooled part of the kiln is compared with the wall temperature obtained at a reduced speed without cooling. The temperature were measured by sampling.

(3) Controlled cooling by cooling pipes installed in the refractory lining

Figure 9:
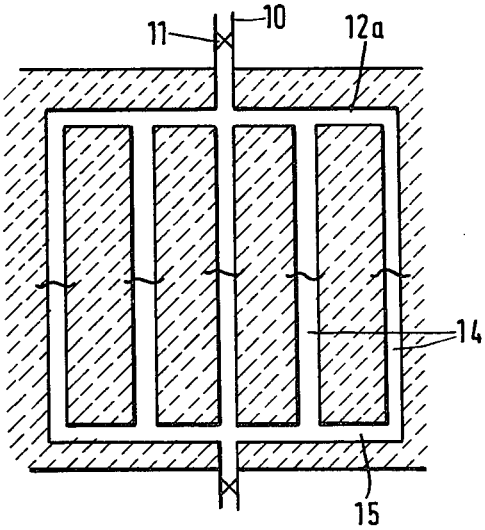
FIG. 9 shows a cooling register according to FIG. 8.

FIGS. 8 and 9 show a system for a controlled cooling of the inside surface of a kiln by means of a network of cooling pipes. Instead of the spray pipes 12 shown in FIGS. 1 and 2, distributing pipes **12*a* are connected to the branch pipes 10 and lead to the cooling pipes 14. The cooling fluid is drained through the collecting pipes 15 and the drain pipe 16 (FIG. 8**). Just as in the system for cooling with sprinkled water, the motor-operated valves for supplying cooling fluid to the cooling segments are controlled by two thermocouples and by a differential voltage measurement effected by means of sensors and an automatic control system.

The cooling fluid flows through the cooling pipes, which are installed in the refractory lining and extend parallel or at right angles to the kiln axis to form cooling segments and may constitute sheetlike pipe banks or cooling coils. The several cooling segments divided into zones about 1.5 meters long are supplied with cooling fluid from a common supply manifold. The heated cooling fluid is withdrawn through a collecting manifold. Depending on its temperature level, heat may be recovered from the heated cooling fluid.

The accuracy of the controlled cooling depends on the measuring and control instrumentation and on the degree to which the cooling system is divided into numerous cooling segments, which can be individually controlled. A separate cooling of each section of 1.5 meters of the length of the kiln is believed to be adequate.

Different from the means for cooling by a sprinkling of water, the manifolds for supplying and removing the cooling fluid are firmly installed on the rotary kiln and are supplied and drained via rotary couplings at the dischaege end of the kiln so that an adequate pressure in the conduits is insured for the cooling segments at the discharge end of the kiln, where the highest temperatures occur. When the rotary kiln is being relined, the cooling pipes are installed in plastic refractory materials.

The advantages afforded by the invention reside in that a formation of crusts in the rotary kiln can be reliably avoided even when the maximum temperarure of the charge is maintained very close to the softening point or melting point of charge components. In addition, it is now possible to charge various raw materials which previously could not be processed in the rotary kiln at all or only with difficulties because they tended to exhibit a premature softening on the surface. The consumption of refractory lining is also reduced. Additional advantages afforded by the invention reside in that a sintering and formation of crusts during short-time troubles can be reliably avoided with simple means so that trouble during the succeeding operation of the kiln can be avoided.

The advantages afforded by the invention reside also in that a formation of crusts can be reilably avoided in a simple manner and particularly in the processing of fine-grained materials, during troubles in operation and when the temperature of the charge is maintained close to the softening point of components of the charge.

What is claimed is:

1. In a process of thermally treating bulk material with hot gases in a rotary kiln below the melting point of the charge components in the rotary kiln while cooling the shell and refractory lining of the kiln, the improvement which comprises cooling several sections of the rotary kiln in which the charge is at about the highest permissible temperature in regard to the formation of crusts if the temperature of the charge rises further in contact with the hot inner surface, by a cooling medium and adjusting the temperature of the inside surface of the kiln at the point where it becomes submerged below the charge in said region so that it is at or up to 50° C. below the temperature of the charge in said regions thereby controllably dissipating heat through the lining of the kiln to said cooling medium.

2. A process according to claim 1 wherein cooling is effected by sprinkling water in a controlled manner on sections of the shell of the kiln.

3. A process according to claim 2 wherein water is sprinkled on the shell of the rotary kiln when the latter is operated at a reduced speed or is stopped.

4. A process according to claim 3 wherein water is sprinkled on those sections of the shell in which a retention of heat causes the temperature in the charge to exceed the temperature at which crust form on the surface.

5. A process according to claim 3 wherein the means for sprinkling water are connected to sensing means for detecting a rise in the temperature to a value above a pre-set value or for detecting a decrease in the speed or rate of rotation of the rotary kiln which sensing means is operable to actuate the sprinkling of water onto at least one section of the shell of said kiln.

6. A process according to claim 2 wherein at least a major part of the water is sprinkled on that portion of the shell of the kiln which is opposite to the rolling bed formed by the charge.

7. A process according to claim 1 wherein cooling is effected by passing a cooling medium through at least one pipe installed in the refractory lining of the kiln.

8. A process according to claim 7 wherein the heated cooling medium so obtained is passed to another apparatus wherein the heat is dissipated so as to perform a function.

9. A process according to claim 7 wherein more energy is supplied to the rotary kiln than is required for carrying out the process and the surplus heat is utilized to heat the cooling fluid in the pipes to a temperature which is favorable for other purposes.

10. A process according to claim 1 wherein the temperature of the inside surface of the rotary kiln and the temperature of the charge are measured in several sections of the rotary kiln and the dissipation of heat is controlled in dependence on the temperature difference.

11. A process according to claim 1 wherein said rotary kiln is used to produce sponge iron and said rotary kiln is cooled throughout the length of the reducing zone and cooling begins approximately where wüstite normally begins to form.

12. A process according to claim 5, wherein said means for sprinkling water is connected to a sensing means for detecting a decrease in the speed or rate of rotation of the rotary kiln which sensing means is operable to actuate the sprinkling of water onto at least one section of the shell of said kiln.

* * * * *